United States Patent [19]

Lancaster et al.

[11] 4,177,959

[45] Dec. 11, 1979

[54] FLYING SPLICE APPARATUS AND PROCESS

[76] Inventors: William G. Lancaster, 5101 Upper River Rd.; Patrick R. Lancaster, III, 2606 N. Osage, both of Louisville, Ky. 40200

[21] Appl. No.: 947,828

[22] Filed: Oct. 2, 1978

[51] Int. Cl.[2] ..... B65H 19/18

[52] U.S. Cl. ..... 242/58.2; 156/157; 156/504; 206/389

[58] Field of Search ..... 242/58.1, 58.2, 58.3, 242/58.4, 58.5, 58, 57; 156/157, 159, 502, 504

[56] References Cited

U.S. PATENT DOCUMENTS

| | | | |
|---|---|---|---|
| 2,070,317 | 2/1937 | Roesen | 242/58.2 |
| 3,467,334 | 9/1969 | Chesnut et al. | 242/58.3 |

*Primary Examiner*—Stanley N. Gilreath
*Attorney, Agent, or Firm*—Gipple & Hale

[57] ABSTRACT

An apparatus and process for effecting a flying splice of vertically positioned rolls of plastic film mounted on a reel. Each supply roll of film has an adhesive strip extending diagonally across the leading edge of the film web with a sleeve member mounted to the bottom of the adhesive strip. The sleeve member is moveably mounted on a guide member mounted to the reel to hold the leading edge in position and in correct orientation for its engagement with the film web of the expiring roll. The supply roll when rotated by the reel positions the leading edge of the supply roll with its adhesive strip against film web dispensed from the expiring roll, so that the leading edge of the film web of the supply roll is carried off the roll, with the sleeve member being carried off of the guide member.

17 Claims, 9 Drawing Figures

FLYING SPLICE APPARATUS AND PROCESS

BACKGROUND OF THE INVENTION

1. Field of the Invention

The present invention is basically directed towards a flying splice for attaching the leading end of a roll of replacement material to the trailing end of an expiring roll of material, and is more particularly directed towards a flying splice for attaching the leading edge of a vertically oriented replacement roll of plastic material to the trailing edge of a vertically oriented expiring roll of plastic material to form a continuous film web.

2. Description of the Prior Art

The concept of a flying splice joining the leading edge of a new roll of material onto the trailing edge of an exhausted roll of material is old in the art. One such example is shown by U.S. Pat. No. 3,861,612. This patent discloses an automatic tape splicer in which an elastic member is placed on the outer surface of a removable covering so that a hook member of a splicer head can engage the elastic member to peel off the removable covering permitting adhesive material placed on the roll to be exposed for the splicer.

Two lengths of adhesive tape having both inner and outer surfaces coated with adhesive material are placed on the outer surface of the leading portion of the rolled paper along the tapered edges of the roll. The two lengths of adhesive tape are covered with flexible tapes, preferably made of paper having an inner surface coated with a suitable material which has no affinity to the adhesive material coated on the adhesive tapes. When the elastic member of the supply roll is subsequently engaged by a needle portion of the hook member, the covering is moved away from the peripheral surface of the supply roll causing the corresponding removal of the pair of flexible tapes to expose the adhesive tapes on the tapered surface. The adhesive tapes are placed on the leading edge portion of the paper of the supply paper roll along the tapered edges, and adhere gradually but steadily to the trailing end portion of the expiring paper roll to maintain a continuous web feed completing the splicing operation.

U.S. Pat. No. 3,198,452 discloses a flying splice apparatus in which the supply roll is cut in a zig zag pattern to provide greater contact area across the web with the splicing tape being applied at an angle with respect to the axis of the roll. A first adhesive is applied to the roll along a portion of the border zone adjacent the leading edge of the new web roll and a second adhesive is then applied to the remaining portion of that zone. Raised non-adhesive strips are secured to the roll in the remaining position of the zone. The roll is rotated by a drive belt which runs over the non-adhesive strips so that the roll will obtain a requisite speed in relation to that of the tensioned web being discharged from the expiring roll to effect a satisfactory splice.

U.S. Pat. No. 2,379,495 discloses a flying splice arrangement in which an air blast emanating from a nozzle is used to start the severed web end around the rotating core roll initiating winding of a new roll. U.S. Pat. No. 1,739,381 utilizes a layer of grease between the top and underlying layers of a leading end of a fresh roll, so as to hold the web end against the roll prior to splicing and eliminate resistance to the end being taken off the running web.

Another U.S. Pat. No. 3,161,367 relates to a flying splice in which a suction transfer roll removes the lead end of the web from a fresh roll and transfers it to the nip to press it against a strip of adhesive applied across the web width by a glue application.

U.S. Pat. No. 2,172,766 is directed to a flying splice arrangement in which the leading edge of a fresh roll of web material has an adhesive strip provided with a shield and held in place by frangible tabs. When the tabs are severed the shield is removed by centrifugal force to expose a tacky adhesive strip. In another U.S. Pat. No. 2,320,657 adhesive shields are provided for covering the tacky adhesive on the leading end of a new roll of web material. These shields are removed at the time of the splice by a retractable transfer roll.

In addition many other patents are directed towards various embodiments of apparatus for flying splices. U.S. Pat. Nos. 2,110,976; 2,149,833; 2,386,345; 2,553,928; 3,001,735; and 3,198,452 are all directed to various arrangements of tacky adhesive tabs or strips on a fresh roll to be utilized in a roll replenishing flying splice operation. U.S. Pat. Nos. 3,974,490; 3,948,715; 3,920,502; 3,915,399 and 3,895,763 disclose various concepts for splicing the trailing end of an expiring web of an old roll to the leading web of a new roll and are included primarily for purpose of presenting a broader picture of patents in the area of flying splice apparatus and processes.

SUMMARY OF THE INVENTION

While the aforementioned prior art splicing apparatus works well on materials such as paper and the like, they do not operate effectively with vertically oriented rolls of plastic material such as polypropolene, polyvinylchloride and polyethylene. The rolls being positioned vertically have a tendency for the leading edge of the film web to unroll and to fall downward covering the adhesive strip or presenting a small portion of the adhesive strip for splicing purposes. When the leading edge of a film roll is correctly oriented on tacky films such as polyvinylchloride or tacky polypropolene a resistance between film layers is encountered which when combined with the imbalance of forces brought about by the difference in film speed between the supply roll film web and the rapidly moving expiring film web may be sufficient to prevent a flying splice. The present invention solves this problem by eliminating the takeup force necessary for pulling the leading edge of the film off of the supply roll, while orientating the position of the leading edge of the film web of the supply roll, so that the adhesive splice is true and the film is carried away. In the inventive flying splice arrangement both the preceding and succeeding rolls are mounted on a pivotally moveable reel which moves the supply roll into the position of the expiring roll when the flying splice is to be effected. The leading end of the fresh or supply roll is provided with a diagonally extending strip of tacky adhesive along its forward edge by means of which the attachment of the leading end of the trailing end of the expired roll is effected. The adhesive strip is wrapped around a sleeve member at the bottom of the roll which is in turn mounted on a guide to keep the film in a correct position.

The above-mentioned purposes and operation are more readily apparent when read in conjunction with the following detailed description of a preferred embodiment of the present invention.

DETAILED DESCRIPTION OF THE DRAWINGS

Figure 1:
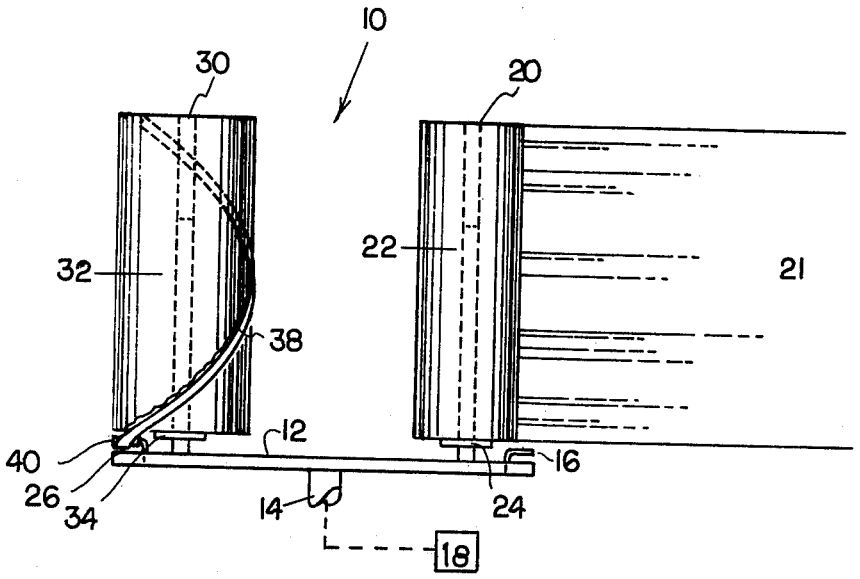
FIG. 1 is a side elevational view of the inventive apparatus in which film is being withdrawn from the leading roll.
Figure 2:
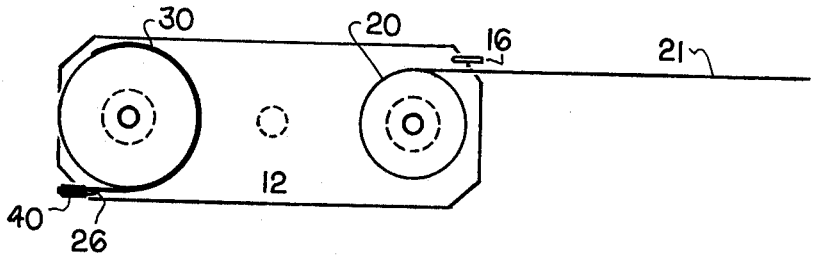
FIG. 2 is a top plan view of the apparatus shown in FIG. 1.

The flying splice apparatus as shown in FIGS. 1 through 9 comprises apparatus which can be used in conjunction with U.S. Pat. Nos. 4,077,179 and 4,050,211 both of which patents are incorporated by reference into this application for the purposes of showing apparatus on which the flying splice apparatus 10 could be used.

The flying splice apparatus 10 comprises a reel 12 mounted to a rotatable rod 14 which is adapted to be rotated by rotation means 18 which is well known in the art. The rotation means can comprise a motor driven belt, chain linkage, gear assembly, roller assembly, rack and pinion gear or any other means well known in the art. The reel 12 has guide members 16 and 26 mounted on it along with roll support rods 22 and 32. A lead roll of film 20 is mounted on the roll support rod 22 with one end abutting a circular stop 24 which keeps the roll positioned on the roll support rod, so that a film web 21 can be withdrawn from the roll and wrapped around a load not shown. The film web 21 is preferably stretched by brake means which engages the film roll or by a series of dancer bars not shown to tension the film so that it is stretched as it is wrapped around a load.

Figure 3:
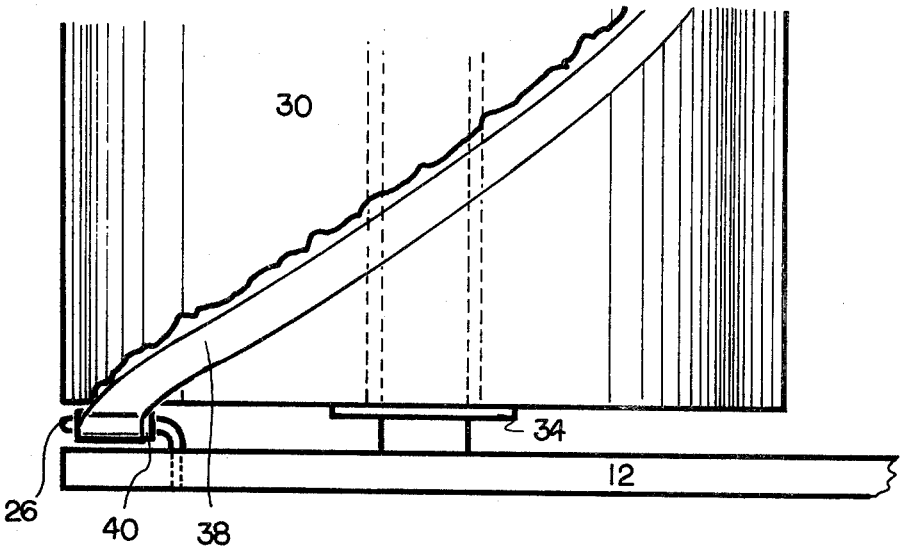
FIG. 3 is an enlarged partial side elevational view of the supply roll shown in FIG. 1.
Figure 4:
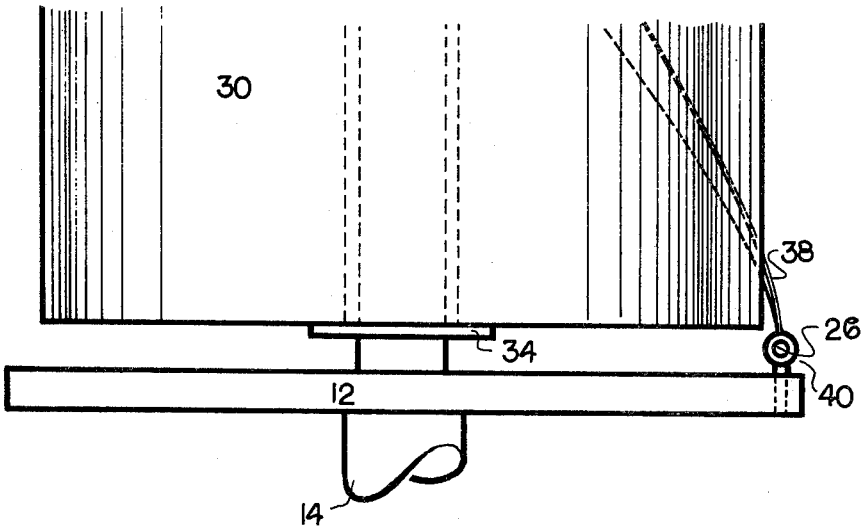
FIG. 4 is an enlarged partial front elevational view of the supply roll shown in FIG. 1.
Figure 5:
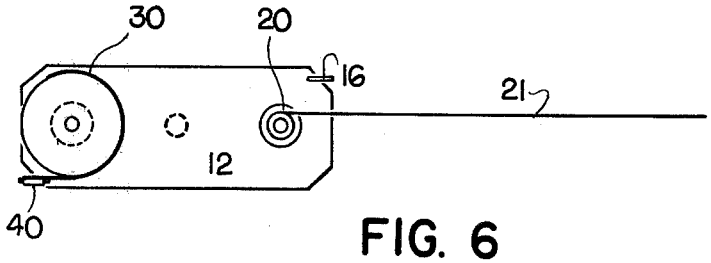
FIG. 5 is a top plan view of the inventive apparatus showing the expiring lead roll.
Figure 6:
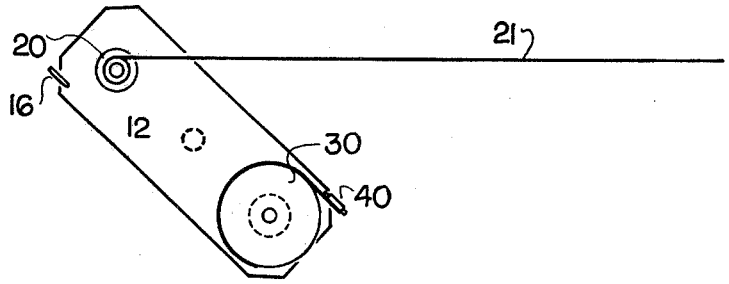
FIG. 6 is a top plan view of the inventive apparatus shown in FIG. 5 in which the reel is rotated as the lead roll expires.
Figure 7:
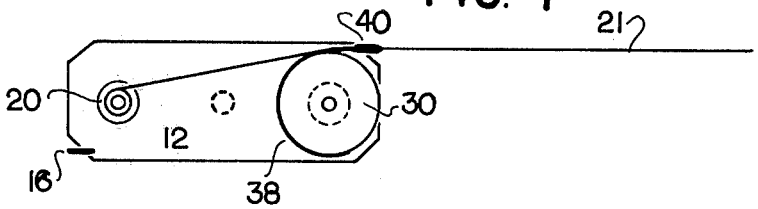
FIG. 7 is a top plan view of the apparatus shown in FIG. 6 in which the reel of the inventive apparatus has been rotated, so that the leading edge of the supply roll engages the trailing film web of the lead roll to accomplish a flying splice.

A supply roll 30 is mounted on roll support rod 32 and abuts stop 34 which holds the roll vertically in position parallel with roll 20 and vertical to the reel 12. The supply roll is provided with an adhesive strip 38 which is fastened to the forward edge of the film web. The strip is coated on both sides with adhesive and is diagonally orientated with respect to the axis of the roll. The end of the strip is wrapped around a sleeve member 40 which is preferably a plastic soda straw portion. The edge of the film web is severed along the edge of the adhesive strip so that the leading edge of the film web is diagonally shaped with the lower edge of the web extending forward of the upper edge of the web. The guide member 26 extends through the sleeve member 40 and holds the film edge in position for the flying splice. This relationship is best shown in FIGS. 1, 3 and 4 of the drawings. When the lead roll 20 has almost expired as shown in FIG. 5 the reel 12 is rotated to effect the take-up of the leading end of the supply roll of film 30. The expiration of the film roll 20 can be sensed by electric eye means, feeler gauge means, electrical circuit means or any other means known in the art.

Figure 8:
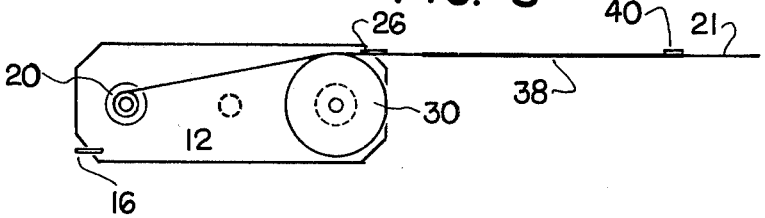
FIG. 8 is a top plan view of the flying splice apparatus shown in FIG. 7 in which the flying splice has been effectuated and the leading edge of the supply roll and its associated sleeve member is carried away by the trailing edge of the lead roll.
Figure 9:
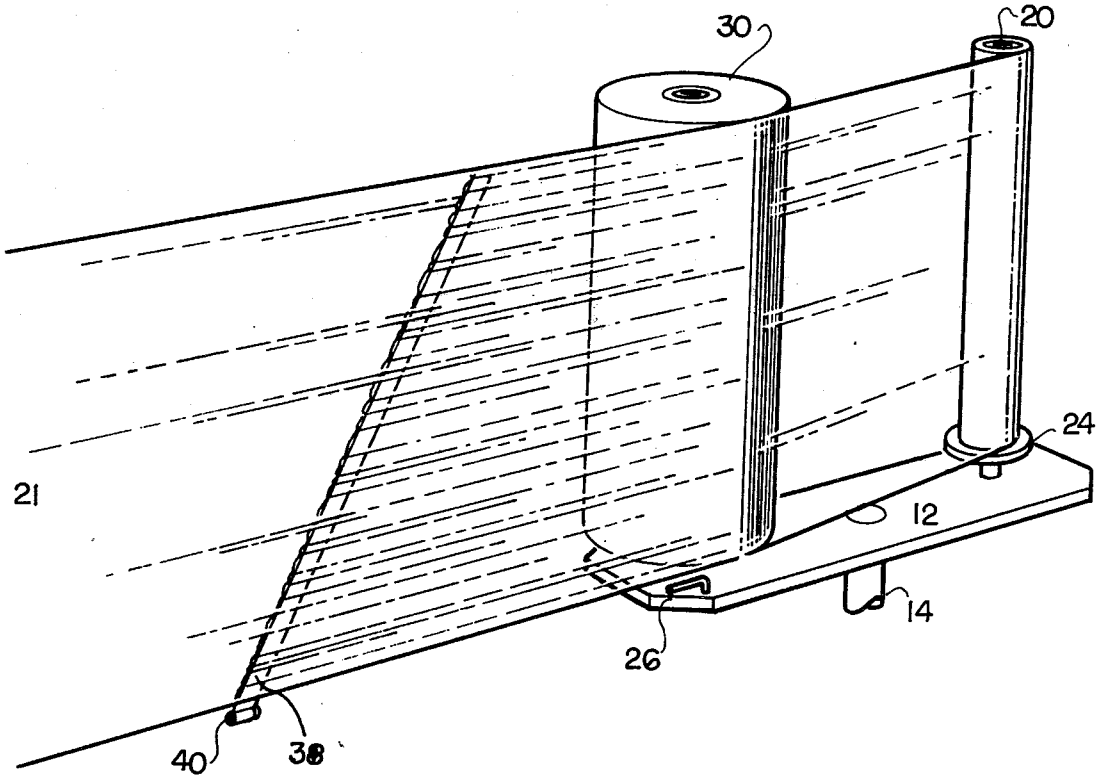
FIG. 9 is an enlarged perspective view of the flying splice apparatus shown in FIG. 8.

In operation of the flying splice the leading edge of the film from the supply roll 30 is rotated into the trailing web of the film being discharged from roll 20, so that the film web 21 engages the leading edge and adhesive strip of the supply film web. The sleeve member 40 wrapped in the adhesive strip 38 is mounted on the guide member 26. When the splice is effected the diagonally cut film edge is readily picked up by the trailing web of the expiring roll 20 with the sleeve member 40 being carried away with the film as shown in FIGS. 8 and 9. Thus a splice is consistently accomplished without separation of the leading edge of the supply roll from the trailing edge of the lead roll.

It should be noted that the steps of the splicing process can be interchangeable in order without departing from the scope of the invention. Furthermore, it is apparent that the initial steps of placing the adhesive strip onto the film web and severing the film web can be interchanged and are equivalents.

In the foregoing description the invention has been described with reference to a particular preferred embodiment although it is to be understood that the specific details shown are merely illustrative and that the invention may be carried out in other ways without departing from the true spirit and scope of the following claims.

What is claimed is:

1. An apparatus for effecting a flying splice of vertically positioned rolls of plastic film comprising a reel, means connected to said reel to rotate said reel, a plurality of roll supporting members mounted to said reel, at least one guide member mounted to said apparatus, a roll of plastic film mounted on each of said roll support members, at least one of said rolls being provided with an adhesive strip extending angularly across the surface of the leading edge of the film web with mounting means mounted to said angularly oriented adhesive strip, said mounting means being moveably mounted on one of said guide members, said reel when rotated bringing film dispensed from a lead roll into contact with the adhesive strip on the leading edge of another roll so that the leading edge of the film of the roll is carried off of the roll and said mounting means is carried off of said guide member.

2. An apparatus as claimed in claim 1 wherein said mounting means is a sleeve member.

3. An apparatus as claimed in claim 2 wherein said sleeve member is a soda straw.

4. An apparatus as claimed in claim 1 wherein said strip has adhesive on each side.

5. An apparatus as claimed in claim 2 wherein said sleeve member is mounted to said adhesive strip by wrapping said adhesive strip around said sleeve member.

6. An apparatus as claimed in claim 1 wherein the leading edge of the film web is cut along the edge of the adhesive strip so that said adhesive strip forms substantially the forward edge of the leading edge of the film web.

7. An apparatus as claimed in claim 1 wherein said guide member is a substantially L-shaped pin having one leg with a diameter small enough to be inserted in said strip mounting means.

8. An apparatus as claimed in claim 7 wherein said small diameter leg of said L-shaped guide member is parallel to said reel surface, and extends in the direction in which film is withdrawn from the roll.

9. An apparatus for effecting a flying splice between an expiring roll and a supply roll of vertically positioned rolls of plastic film rotatably mounted on a base plate comprising means connected to said base plate to rotate said base plate, a plurality of roll support members mounted to said base plate, a plurality of guide members mounted to said base plate, a roll of plastic film mounted on each of said roll support members, at least one of said rolls of film being provided with an adhesive strip extending diagonally along the surface of the leading portion of the film web, the film web being cut substantially along the edge of the adhesive strip so that the adhesive strip substantially forms the forward edge of the leading edge of the film web and sleeve means connected to said diagonal strip for mounting said diagonal strip on said guide member, said base plate when rotated bringing the leading edge of the film of a supply roll into contact with the film web dispensed from the expiring roll so that the leading edge of the film of the supply roll is fastened to the trailing web portion of the expiring roll and is carried off of the supply roll with the sleeve means being carried off of said guide member.

10. A roll of plastic film adapted for use on vertically positioned rolls for effecting a flying splice comprising a roll of plastic film, the leading edge of said plastic film being cut diagonally, an adhesive strip fastened along the edge of the diagonally cut film and tubular means mounted to said adhesive strip at the leading corner of said diagonally cut leading edge, said tubular means being spaced from said roll of film and oriented parallel to the bottom edge of said roll of film to receive a guide member.

11. A roll of plastic film as claimed in claim 10 wherein said film is polypropolene.

12. A roll of plastic film as claimed in claim 10 wherein said film is polyvinylcloride.

13. A roll of plastic film as claimed in claim 10 wherein said film is polyethylene.

14. A roll of plastic film as claimed in claim 10 wherein said sleeve means is a straw with said adhesive strip wrapped around it.

15. A method performing a flying splice between an expiring roll and a supply roll of vertically oriented rolls of plastic film comprising the steps of:

applying an adhesive strip on the leading edge of a supply roll of plastic film;

fastening said adhesive strip to a sleeve member;

mounting said sleeve member on a guide member;

rotating an expiring roll of film in which film is being dispensed so that the trailing portion of the film web of said expiring roll engages the adhesive strip leading edge of said supply roll; and fastening the trailing portion of the film web of the expiring roll to the adhesive strip so as to carry off the leading edge of film of the supply roll and its associated sleeve member.

16. A method of performing a flying splice between an expiring roll and a supply roll of vertically oriented rolls of plastic film comprising the steps of:

applying an adhesive strip to a leading edge of a roll of plastic film in a diagonal orientation;

severing the leading edge of the plastic film substantially along the adhesive strip to form a diagonally cut leading edge;

fastening said strip to a tubular member at the leading corner of said diagonally cut leading edge;

placing said tubular member around a guide member so that said leading corner is spaced apart from said roll of film and said tubular member is removable from said guide member in the direction of film dispensation; and rotating said expiring roll so that a trailing web of film being taken off said expiring roll engages the adhesive strip leading edge of said supply roll to fasten the leading edge of the supply roll film to the trailing web of the expiring roll of film web carrying off the leading film web and the tubular member of the supply roll.

17. A method of performing a flying splice as claimed in claim 16 wherein said tubular member is fastened to said adhesive strip by wrapping said adhesive strip around said tubular member.

* * * * *